US009704640B2

(12) United States Patent
Choi et al.

(10) Patent No.: US 9,704,640 B2
(45) Date of Patent: Jul. 11, 2017

(54) CHIP ELECTRONIC COMPONENT AND MANUFACTURING METHOD THEREOF

(71) Applicant: SAMSUNG ELECTRO-MECHANICS CO., LTD., Suwon-Si, Gyeonggi-Do (KR)

(72) Inventors: Youn Kyu Choi, Suwon-Si (KR); Hye Ah Kim, Suwon-Si (KR); Yun Young Yang, Suwon-Si (KR); Mi Jung Kang, Suwon-Si (KR); Jae Yeol Choi, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 58 days.

(21) Appl. No.: 14/705,886

(22) Filed: May 6, 2015

(65) Prior Publication Data

US 2016/0086716 A1 Mar. 24, 2016

(30) Foreign Application Priority Data

Sep. 18, 2014 (KR) ..... 10-2014-0124379

(51) Int. Cl.
*H01F 27/24* (2006.01)
*H01F 5/00* (2006.01)
(Continued)

(52) U.S. Cl.
CPC ..... *H01F 27/292* (2013.01); *H01F 17/0006* (2013.01); *H01F 17/04* (2013.01); *H01F 2017/048* (2013.01)

(58) Field of Classification Search
USPC ..... 336/200, 233, 232
See application file for complete search history.

(56) References Cited

U.S. PATENT DOCUMENTS 4,069,360 A * 1/1978 Yanagisawa ..... G11B 5/71 360/131
7,659,568 B2 * 2/2010 Kusano ..... H01G 4/2325 257/303
(Continued)

FOREIGN PATENT DOCUMENTS

CN 1812024 A 8/2006
CN 101572185 A 11/2009
(Continued)

OTHER PUBLICATIONS

Enlgish translation of JP2013254917.*
(Continued)

*Primary Examiner* — Mangtin Lian
*Assistant Examiner* — Ronald Hinson
(74) *Attorney, Agent, or Firm* — McDermott Will & Emery LLP

(57) ABSTRACT

There is provided a chip electronic component including; a magnetic body containing magnetic metal powder; an internal coil part embedded in the magnetic body; and a plating spreading prevention part coated on a surface of the magnetic body. The plating spreading prevention part contains phosphate-based glass. Whereby, plating spread generated in the surface of the chip electronic component at the time of forming the external electrodes may be prevented.

8 Claims, 8 Drawing Sheets

(51) Int. Cl.

| | |
|---|---|
| ***H01F 27/28*** | (2006.01) |
| ***H01F 27/29*** | (2006.01) |
| ***H01F 17/00*** | (2006.01) |
| ***H01F 17/04*** | (2006.01) |

(56) References Cited

U.S. PATENT DOCUMENTS

| | | | | |
|---|---|---|---|---|
| 2006/0037690 | A1 | 2/2006 | Ishiyama et al. | |
| 2006/0152321 | A1 | 7/2006 | Jung et al. | |
| 2007/0030108 | A1* | 2/2007 | Ishimoto | H01F 10/14 336/200 |
| 2009/0268372 | A1 | 10/2009 | Ogawa et al. | |
| 2010/0289609 | A1* | 11/2010 | Liao | H01F 17/04 336/221 |
| 2013/0249662 | A1* | 9/2013 | Tonoyama | H01F 27/255 336/200 |

FOREIGN PATENT DOCUMENTS

| | | | |
|---|---|---|---|
| CN | 101783226 | A | 7/2010 |
| CN | 102789876 | A | 11/2012 |
| CN | 102965655 | A | 3/2013 |
| JP | 2008-166455 | A | 7/2008 |
| JP | 2013-254917 | A | 12/2013 |
| KR | 10-2006-0081493 | A | 7/2006 |

OTHER PUBLICATIONS

Chinese Office Action dated Jan. 4, 2017 issued in Chinese Patent Application No. 201510172720.0 (with English translation).

* cited by examiner

CHIP ELECTRONIC COMPONENT AND MANUFACTURING METHOD THEREOF

CROSS-REFERENCE TO RELATED APPLICATION

This application claims the priority and benefit of Korean Patent Application No. 10-2014-0124379 filed on Sep. 18, 2014, with the Korean Intellectual Property Office, the disclosure of which is incorporated herein by reference.

BACKGROUND

The present disclosure relates to a chip electronic component and a manufacturing method thereof.

An inductor, a chip electronic component, is a representative passive element configuring an electronic circuit together with a resistor and a capacitor to remove noise therefrom.

A thin film type inductor is manufactured by forming internal coil parts by plating and manufacturing a magnetic body by curing a magnetic power-resin composite obtained by mixing magnetic power and a resin, and then forming external electrodes on an outer portion of the magnetic body.

RELATED ART DOCUMENT (Patent Document 1) Japanese Patent Laid-Open Publication No. 2008-166455

SUMMARY

An aspect of the present disclosure may provide a chip electronic component having reduced plating spread on a surface of the chip electronic component at the time of forming external electrodes thereon.

According to an aspect of the present disclosure, a chip electronic component may include: a magnetic body containing magnetic metal powder; an internal coil part embedded in the magnetic body; and a plating spreading prevention part coated on a surface of the magnetic body, wherein the plating spreading prevention part contains phosphate-based glass.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
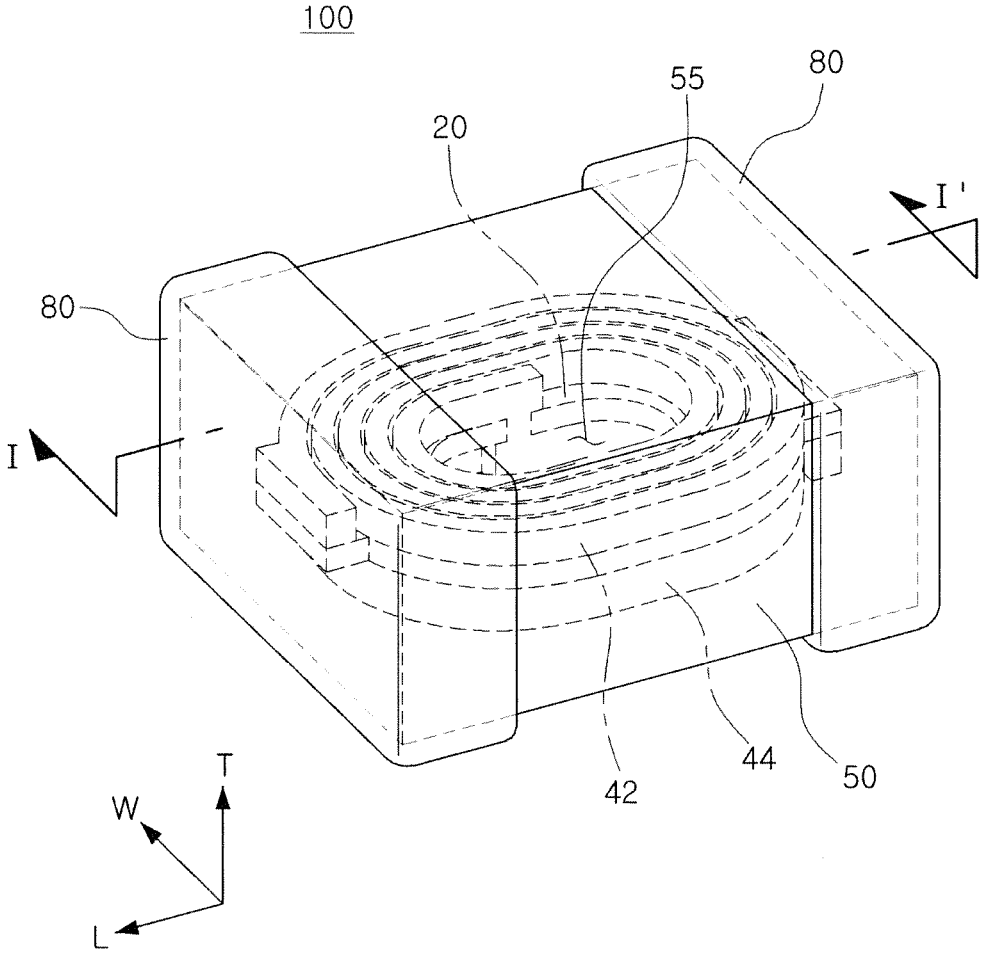
FIG. 1 is a schematic perspective view showing a chip electronic component according to an exemplary embodiment of the present disclosure so that internal coil parts thereof are shown.

Exemplary embodiments of the present disclosure will now be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Chip Electronic Component

Hereinafter, a chip electronic component according to an exemplary embodiment of the present disclosure will be described. Particularly, a thin film type inductor will be described, but the present disclosure is not limited thereto.

FIG. 1 is a schematic perspective view showing a chip electronic component according to an exemplary embodiment of the present disclosure so that internal coil parts thereof are shown.

Referring to FIG. 1, as an example of the chip electronic component, a thin film type chip inductor 100 used in a power line of a power supply circuit is disclosed.

The chip electronic component 100 according to an exemplary embodiment of the present disclosure may include a magnetic body 50, internal coil parts 42 and 44 embedded in the magnetic body 50, and external electrodes 80 disposed on an outer portion of the magnetic body 50 to thereby be electrically connected to the internal coil parts 42 and 44.

In the chip electronic component 100 according to an exemplary embodiment of the present disclosure, a 'length' direction refers to an 'L' direction of FIG. 1, a 'width' direction refers to a 'W' direction of FIG. 1, and a 'thickness' direction refers to a 'T' direction of FIG. 1.

Figure 2:
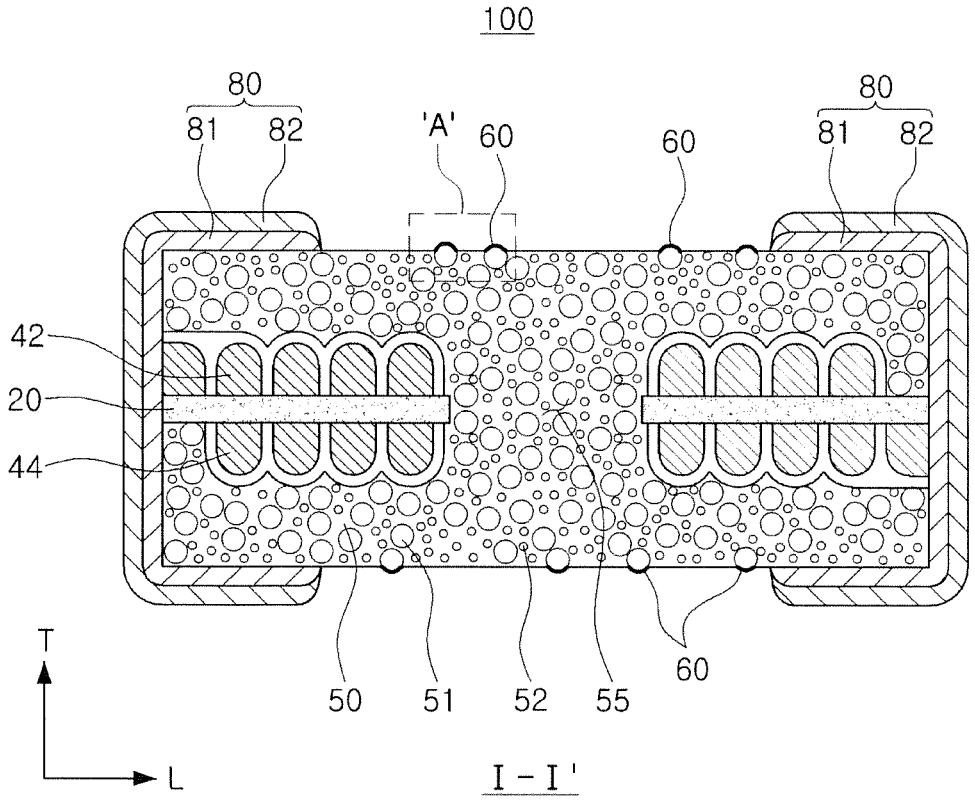
FIG. 2 is a cross-sectional view taken along line I-I' of FIG. 1.

FIG. 2 is a cross-sectional view taken along line I-I' of FIG. 1.

Referring to FIG. 2, the magnetic body 50 may contain magnetic metal powders 51 and 52.

The magnetic metal powders 51 and 52 may contain one or more selected from the group consisting of Fe, Si, Cr, Al, and Ni. For example, the magnetic metal powders 51 and 52 may contain Fe—Si—B—Cr-based amorphous metal, but the present disclosure is not necessarily limited thereto.

The magnetic body 50 may further contain a thermosetting resin, and the magnetic metal powders 51 and 52 may be contained in a form in which the magnetic metal powders 51 and 52 are dispersed in the thermosetting resin such as an epoxy resin, a polyimide resin, or the like.

In order to increase a filling rate of the magnetic metal powder contained in the magnetic body 50, at least two kinds of magnetic metal powders 51 and 52 having different particle sizes may be mixed and prepared at a predetermined ratio.

Magnetic metal powder having high magnetic permeability and a large particle size may be used in order to obtain high inductance at a predetermined unit volume, and magnetic metal powder having a small particle size is mixed with the magnetic metal powder having a large particle size, such that high permeability may be secured by improving a filling rate, and deterioration of efficiency due to a core loss at a high frequency and high current may be prevented.

However, in the case of mixing the magnetic metal powder having a large particle size and the magnetic metal powder having a small particle size with each other as described above, surface roughness of a magnetic body may be increased. Particularly, in a process of grinding a magnetic body cut into an individual chip size, the magnetic metal powder having a large particle size may protrude from a surface of the magnetic body, and an insulation coating layer of a protruded portion may be delaminated.

Therefore, at the time of forming plating layers of external electrodes, a plating spread defect that the plating layer is formed on the magnetic metal powder from which the insulation coating layer is delaminated may occur.

Therefore, according to an exemplary embodiment of the present disclosure, the above-mentioned problem may be solved by forming a plating spreading prevention part 60 on the magnetic body 50.

The plating spreading prevention part 60 may be coated on the magnetic metal powder protruding from the surface of the magnetic body 50 to delaminate the insulation coating layer, thereby serving to prevent plating spread.

A detailed description of the plating spreading prevention part 60 according to an exemplary embodiment of the present disclosure will be provided below.

In the magnetic body 50 according to an exemplary embodiment of the present disclosure, the first magnetic metal powder 51 and the second magnetic metal powder having a $D_{50}$ smaller than that of the first magnetic metal powder 51 may be mixed and contained.

The first magnetic metal powder 51 having a large $D_{50}$ may implement high magnetic permeability, and the first magnetic metal powder 51 having a large $D_{50}$ and the second magnetic metal powder 52 having a small $D_{50}$ may be mixed with each other, such that the filling rate may be improved, thereby further improving magnetic permeability and Q characteristics.

$D_{50}$ of the first magnetic metal powder 51 may be 18 μm to 22 μm, and $D_{50}$ of the second magnetic metal powder 52 may be 2 μm to 4 μm.

$D_{50}$ may be measured by a particle size distribution measuring apparatus using a laser diffraction scattering method.

A particle size of the first magnetic metal powder 51 may be 11 μm to 53 μm, and a particle size of the second magnetic metal power 52 may be 0.5 μm to 6 μm.

The first magnetic metal powder 51 having a large average particle size and the second magnetic metal powder having an average particle size smaller than that of the first magnetic metal powder 51 may be mixed and contained in the magnetic body 50.

An internal coil part 42 having a coil shaped pattern may be formed in one surface of an insulation substrate 20 disposed in the magnetic body 50, and an internal coil part 44 having a coil shaped pattern may be formed on the other surface of the insulation substrate 20.

Examples of the insulation substrate 20 may include a polypropylene glycol (PPG) substrate, a ferrite substrate, a metal-based soft magnetic substrate, and the like.

A central portion of the insulation substrate 20 may be penetrated to thereby form a hole, and the magnetic metal powder is filled in the hole to thereby form a core part 55. As the coil part 55 filled with the magnetic metal powder is formed, inductance may be improved.

In the internal coil parts 42 and 44, a coil pattern may be formed in a spiral shape, and the internal coil parts 42 and 44 formed on one surface and the other surface of the insulation substrate 20 may be electrically connected to each other through a via formed in the insulation substrate 20.

The internal coil parts 42 and 44 and the via may be formed of a metal having excellent electric conductivity. For example, the internal coil parts 42 and 44 and the via may be formed of silver (Ag), palladium (Pd), aluminum (Al), nickel (Ni), titanium (Ti), gold (Au), copper (Cu), platinum (Pt), an alloy thereof, or the like.

One end portion of the internal coil part 42 formed on one surface of the insulation substrate 20 may be exposed to one end surface of the magnetic body 50 in the length (L) direction, and one end portion of the internal coil part 44 formed on the other surface of the insulation substrate 20 may be exposed to the other end surface of the magnetic body 50 in the length direction.

The external electrodes 80 may be formed on both end surfaces of the magnetic body 50 in the length (L) direction so as to be connected to the internal coil parts 42 and 44 exposed to both end surfaces of the magnetic body 50 in the length (L) direction.

The external electrodes 80 may include conductive resin layers 81 and plating layers 82 formed on the conductive resin layers 81.

The conductive resin layers 81 may contain one or more conductive metals selected from the group consisting of copper (Cu), nickel (Ni), and silver (Ag) and a thermosetting resin.

The thermosetting resin may be an epoxy resin, a polyimide resin, or the like.

The plating layers 82 may contain one or more selected from the group consisting of nickel (Ni), copper (Cu), and tin (Sn). For example, nickel (Ni) layers and tin (Sn) layers may be sequentially formed.

At the time of performing a plating process of forming the plating layers 82, the plating spread defect that the plating layer is formed on the magnetic metal powder protruding from the surface of the magnetic body 50 may occur.

However, according to an exemplary embodiment of the present disclosure, the plating spreading prevention part 60 may be formed on the magnetic metal powder protruding from the surface of the magnetic body 50, such that a plating spread phenomenon by the magnetic metal powder, which is coarse powder, may be decreased.

Figure 3:
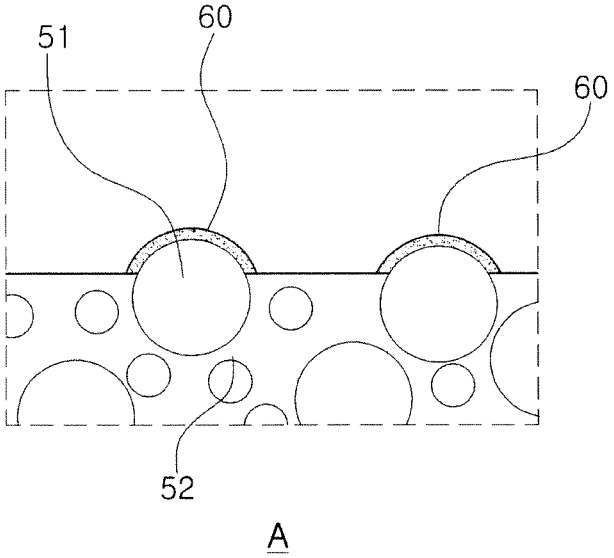
FIG. 3 is an enlarged schematic view of an example of part 'A' of FIG. 1.

FIG. 3 is an enlarged schematic view of an example of part 'A' of FIG. 1.

Referring to FIG. 3, the first magnetic metal powder 51, which is coarse powder, protrudes from the surface of the magnetic body 50 to thereby be exposed, and the plating spreading prevention part 60 may be coated and formed on the exposed first magnetic metal powder 51.

The plating spreading prevention part 60 may be formed by chemically re-coating glass on the exposed magnetic metal powder.

The plating spreading prevention part 60 may contain phosphate-based glass.

The phosphate-based glass may contain one or more selected from the group consisting of iron phosphate, zinc phosphate, and manganese phosphate.

Figure 4:
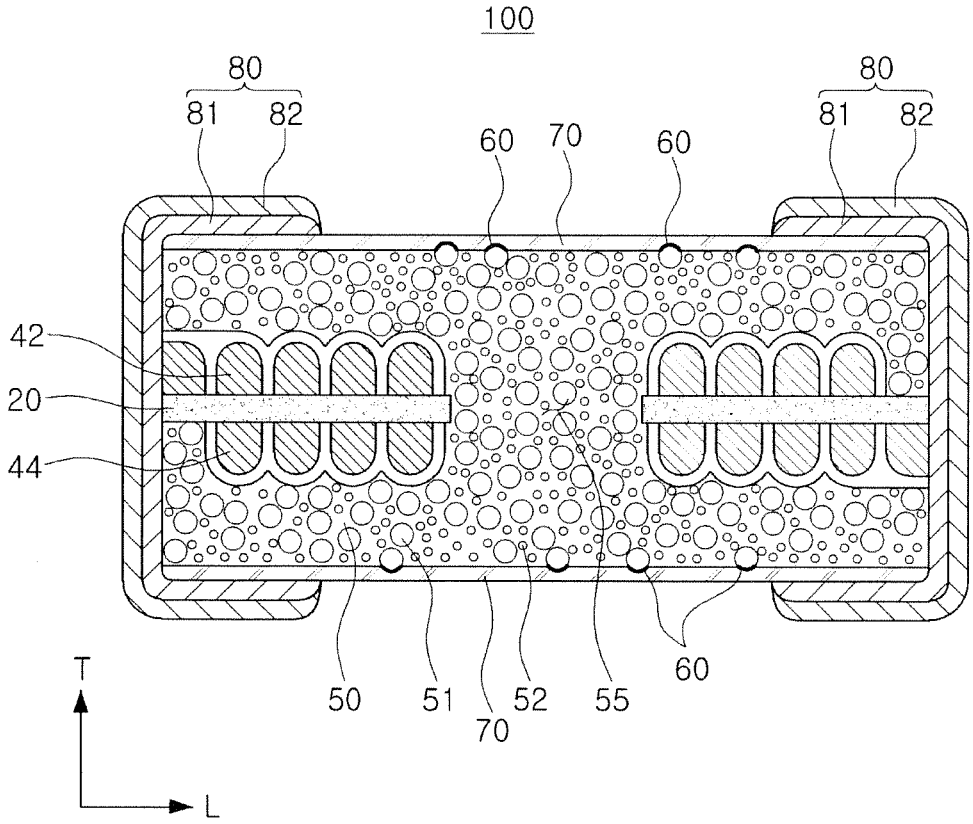
FIG. 4 is a cross-sectional view of a chip electronic component according to another exemplary embodiment of the present disclosure in a LT direction.

FIG. 4 is a cross-sectional view of a chip electronic component according to another exemplary embodiment of the present disclosure in a LT direction.

Referring to FIG. 4, a silicone coating layer 70 may be further formed on the magnetic body 50 on which the plating spreading prevention part 60 is formed.

Plating resistance and acid resistance may be strengthened by further forming the silicone coating layer 70.

As shown in FIG. 4, the silicone coating layer 70 may be formed on upper and lower surfaces of the magnetic body 50 opposing each other in the thickness (T) direction, and may also be formed on both sides surfaces thereof opposing each other in the width (W) direction and both end surfaces thereof opposing each other in the length (L) direction as well as the upper and lower surfaces. However, the present disclosure is not limited thereto, and the silicone coating layer may be disposed on at least one surface of the magnetic body 50.

Manufacturing Method of Chip Electronic Component

FIGS. 5A through 5E are views describing a manufacturing process of a chip electronic component according to an exemplary embodiment of the present disclosure.

Figure 5A:
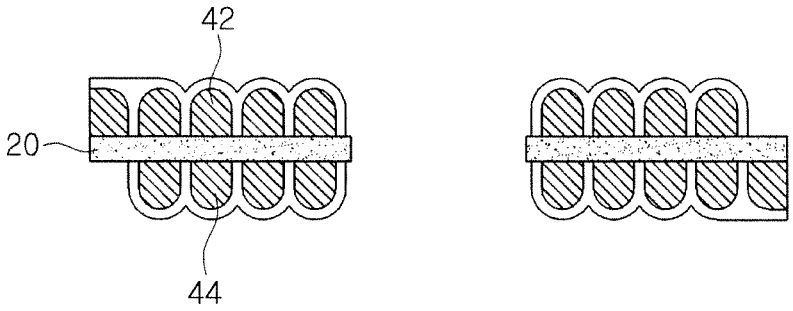
FIGS. 5A through 5E are views describing a manufacturing process of a chip electronic component according to an exemplary embodiment of the present disclosure.
Figure 5B:
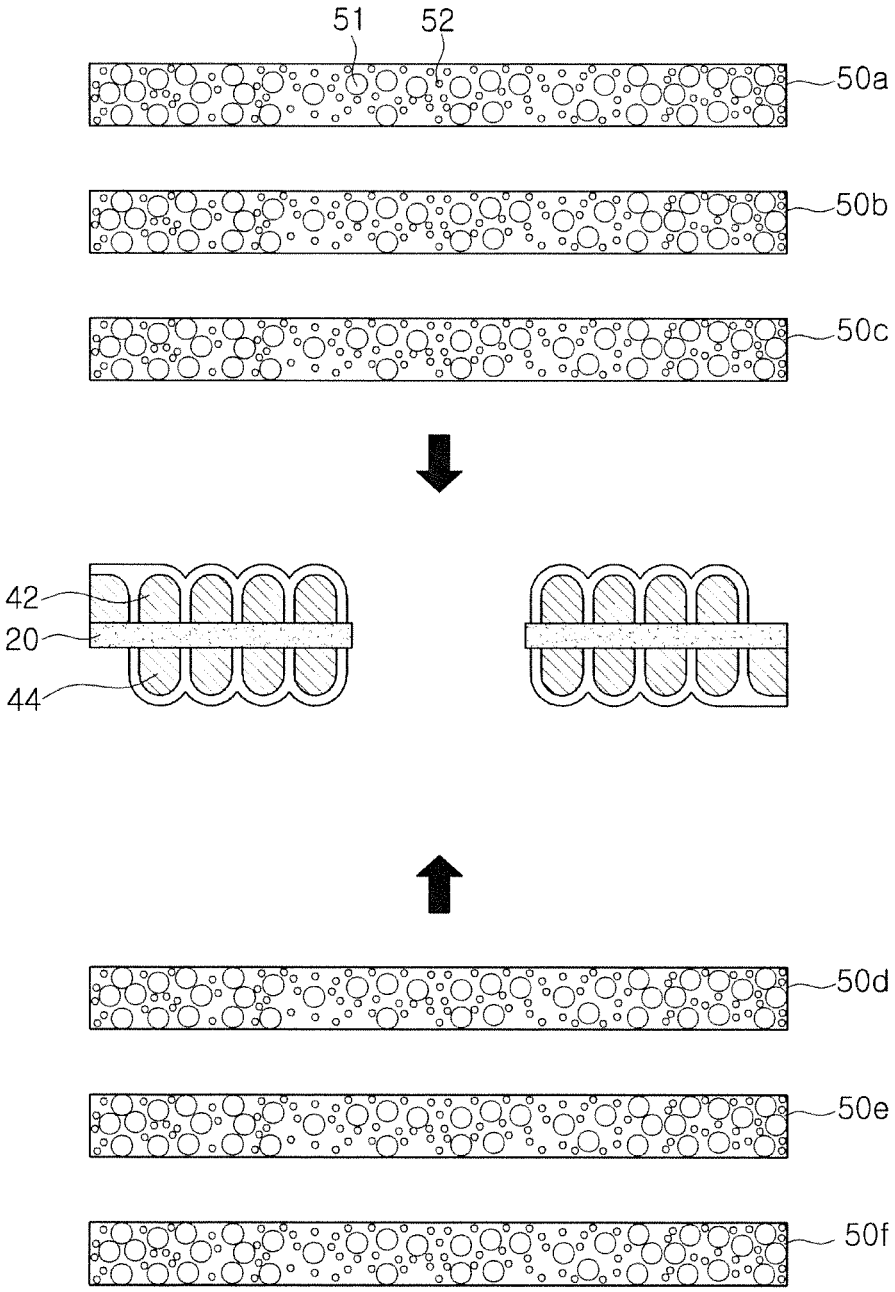

Referring to FIG. 5A, first, internal coil parts 42 and 44 may be formed on one surface and the other surface of an insulation substrate 20.

As a forming method of the internal coil parts 42 and 44, for example, there is an electroplating method, but the present disclosure is not limited thereto. The internal coil parts 42 and 44 may be formed of a metal having excellent electric conductivity. For example, silver (Ag), palladium (Pd), aluminum (Al), nickel (Ni), titanium (Ti), gold (Au), copper (Cu), or platinum (Pt), an alloy thereof, or the like, may be used.

Referring to FIG. 55, a plurality of magnetic sheets 50*a*, 50*b*, 50*c*, 50*d*, 50*e*, and 50*f* may be stacked on upper and lower portions of the internal coil parts 42 and 44.

The magnetic sheets 50*a*, 50*b*, 50*c*, 50*d*, 50*e*, and 50*f* may be manufactured in a sheet form by mixing magnetic powder, for example, magnetic metal power, and an organic materials such as a binder, a solvent, and the like, to prepare slurry, applying the slurry on a carrier film at a thickness of several ten μm using a doctor blade method, and dry the applied slurry.

The magnetic sheets 50*a*, 50*b*, 50*c*, 50*d*, 50*e*, and 50*f* may be formed by mixing first magnetic metal powder 51 and second magnetic metal powder 52 having a $D_{50}$ smaller than that of the first magnetic metal power 51.

$D_{50}$ of the first magnetic metal powder 51 may be 18 μm to 22 μm, and $D_{50}$ of the second magnetic metal powder 52 may be 2 μm to 4 μm.

Figure 5C:
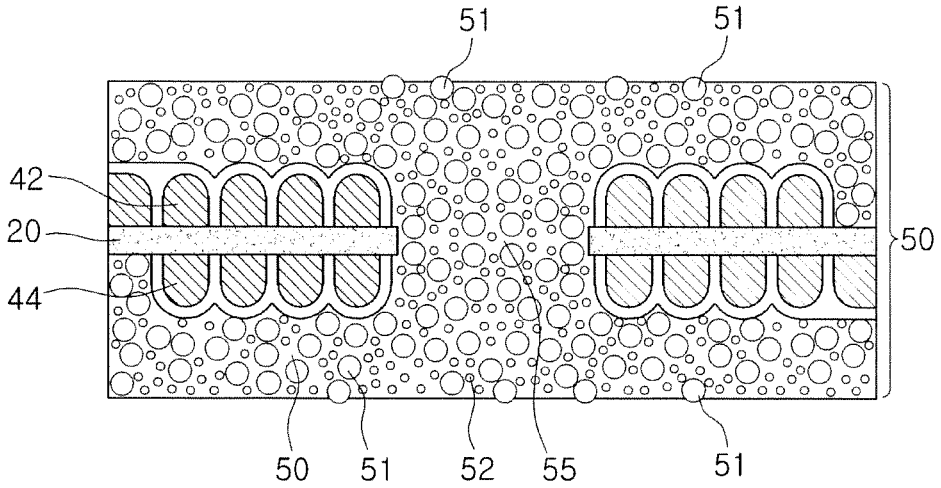

Referring to FIG. 5C, a magnetic body 50 may be formed by stacking the plurality of magnetic sheets 50*a*, 50*b*, 50*c*, 50*d*, 50*e*, and 50*f*, compressing the stacked magnetic sheets using a lamination method or isostatic pressing method, and curing the compressed magnetic sheets.

Here, during a process of grinding a magnetic body cut into an individual chip size, the first magnetic metal powder 51, which is coarse powder, may protrude from a surface of the magnetic body, and an insulation coating layer of a protruded portion may be delaminated.

Therefore, at the time of forming plating layers of external electrodes, a plating spread defect that the plating layer is formed on the magnetic metal powder of which the insulation coating layer is delaminated at the time of forming the plating layer of the external electrode may occur.

Figure 5D:
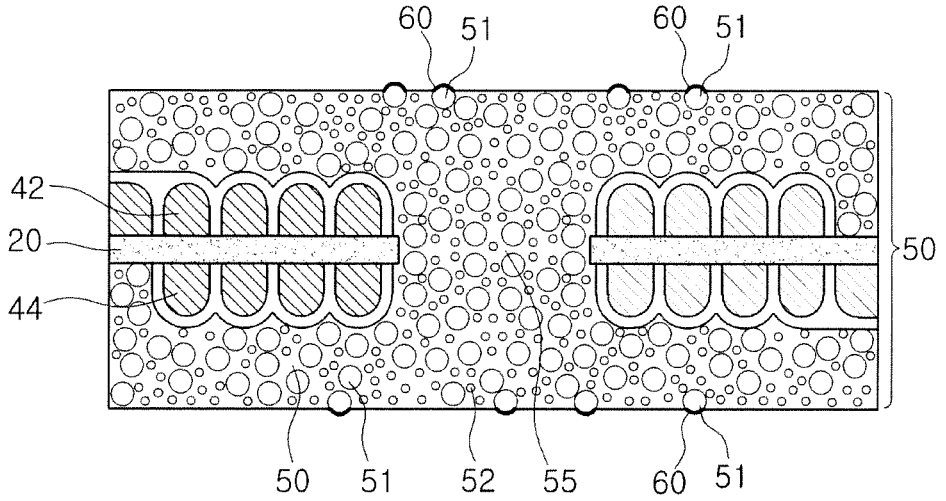

Referring to FIG. 5D, a plating spreading prevention part 60 may be formed on the first magnetic metal powder 52 protruding from the surface of the magnetic body 50 to thereby be exposed.

The plating spreading prevention part 60 may be formed by dipping the magnetic body 50 in a phosphate solution to chemically coat the exposed first magnetic metal powder 52 site.

A molar concentration of the phosphate solution may be 0.1M or more.

In the case in which the molar concentration of the phosphate solution is less than 0.1M, the plating spreading prevention part may not be formed so as to sufficiently cover the exposed magnetic metal powder site, such that a plating spread defect may occur.

A temperature of the phosphate solution may be 50° C. or more.

In the case in which the temperature of the phosphate solution is less than 50° C., the plating spreading prevention part may not be formed so as to sufficiently cover the exposed magnetic metal powder site, such that a plating spread defect may occur.

After the magnetic body 50 is dipped in the phosphate solution and dried, the magnetic body 50 may be heat-treated at a temperature of 180° C. or more.

Hydrates may be converted into insoluble material by heat treatment as described above.

The plating spreading prevention part 60 formed as described above may contain phosphate-based glass.

The phosphate-based glass may contain one or more selected from the group consisting of iron phosphate, zinc phosphate, and manganese phosphate.

A silicone coating layer 70 may be further formed on the magnetic body 50 on which the plating spreading prevention part 60 is formed.

Plating resistance and acid resistance may be strengthened by further forming the silicone coating layer 70.

Figure 5E:
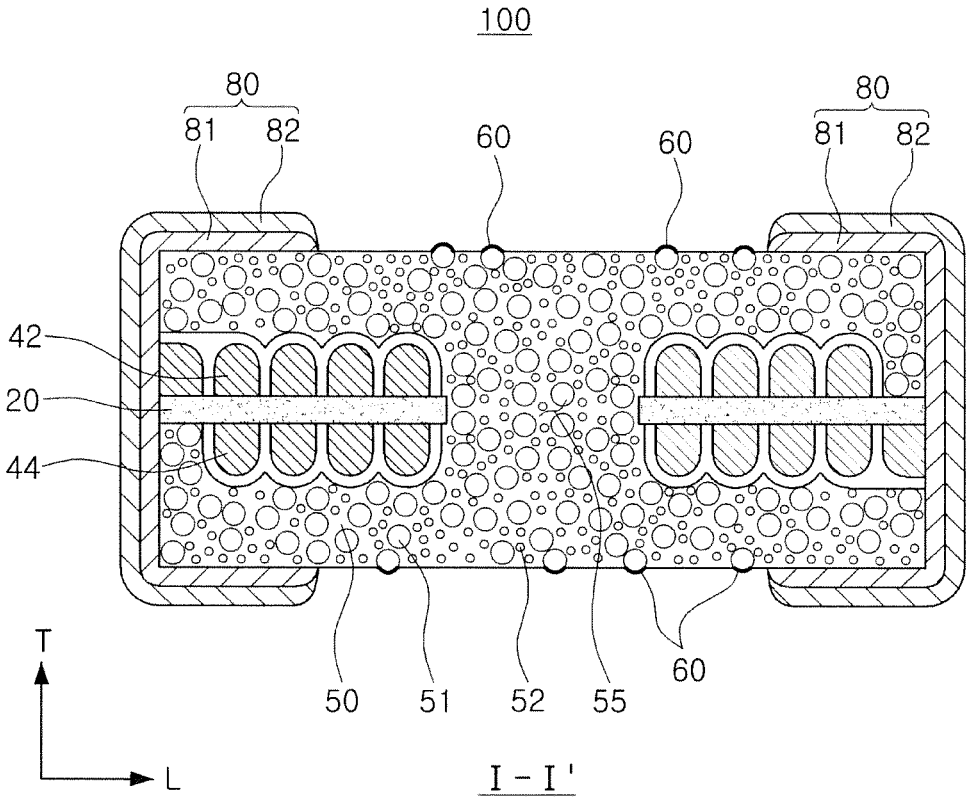

Referring to FIG. 5E, external electrodes 80 may be formed on both end surfaces of the magnetic body 50 in the length (L) direction so as to be connected to the internal coil parts 42 and 44 exposed to both end surfaces of the magnetic body 50 in the length (L) direction.

First, conductive resin layers 81 may be formed on both end surfaces of the magnetic body 50 in the length (L) direction, and then, plating layers 82 may be formed on the conductive resin layers 81.

The conductive resin layers 81 may be formed using a paste containing one or more conductive metals selected from the group consisting of copper (Cu), nickel (Ni), and silver (Ag) and a thermosetting resin, and may be formed, for example, by a dipping method, or the like.

In the plating layers 82, for example, nickel (Ni) layers and tin (Sn) layers may be sequentially formed.

According to an exemplary embodiment of the present disclosure, at the time of performing a plating process of forming the plating layers 82, a plating spread phenomenon that the plating layer is formed on the magnetic metal powder exposed to the surface of the magnetic body 50 may be decreased by forming the plating spreading prevention part 60 on the magnetic metal powder exposed to the surface of the magnetic body 50.

A description of features overlapped with those of the above-mentioned chip electronic component according to an exemplary embodiment of the present disclosure will be omitted.

As set forth above, according to exemplary embodiments of the present disclosure, the plating spread generated in the surface of the chip electronic component at the time of forming the external electrodes may be prevented.

While exemplary embodiments have been shown and described above, it will be apparent to those skilled in the art that modifications and variations could be made without departing from the scope of the present invention as defined by the appended claims.

What is claimed is:

1. A chip electronic component comprising:

a magnetic body containing a magnetic metal powder;

an internal coil part embedded in the magnetic body; and a plating spreading prevention part coated on a surface of the magnetic body, wherein the plating spreading prevention part contains phosphate-based glass, wherein the plating spreading prevention part is coated on a protruded portion of the magnetic metal powder, and wherein the protruded portion protrudes from the surface of the magnetic body and is exposed to the surface of the magnetic body.

2. The chip electronic component of claim 1, wherein the phosphate-based glass contains one or more selected from the group consisting of iron phosphate, zinc phosphate, and manganese phosphate.

3. The chip electronic component of claim 1, further comprising a silicon coating layer disposed on the magnetic body on which the plating spreading prevention part is formed.

4. The chip electronic component of claim 1, wherein the magnetic body contains a first magnetic metal powder and a second magnetic metal powder having a $D_{50}$ smaller than a $D_{50}$ of the first magnetic metal powder, the first magnetic metal power having a $D_{50}$ of 18 μm to 22 μm, and the second magnetic metal power having a $D_{50}$ of 2 μm to 4 μm.

5. The chip electronic component of claim 1, wherein the magnetic body contains the first magnetic metal powder and the second magnetic metal powder having an average particle size smaller than an average particle size of the first magnetic metal powder, the first magnetic metal power having a particle size of 11 μm to 53 μm, and the second magnetic metal power having a particle size of 0.5 μm to 6 μm.

6. The chip electronic component of claim 1, further comprising external electrodes disposed on an outer portion of the magnetic body to be connected to end portions of the internal coil part, wherein the external electrodes include conductive resin layers and plating layers formed on the conductive resin layers.

7. The chip electronic component of claim 6, wherein the plating layers contain one or more selected from the group consisting of nickel (Ni), copper (Cu), and tin (Sn).

8. A chip electronic component comprising:

a magnetic body containing a magnetic metal powder;

an internal coil part embedded in the magnetic body; and a plating spreading prevention part coated on a magnetic metal powder exposed to a surface of the magnetic body, wherein the plating spreading prevention part contains glass, wherein the plating spreading prevention part is coated on a protruded portion of the magnetic metal powder, and wherein the protruded portion protrudes from the surface of the magnetic body and is exposed to the surface of the magnetic body.

* * * * *